US007229031B2

(12) United States Patent
Schmidt

(10) Patent No.: US 7,229,031 B2
(45) Date of Patent: Jun. 12, 2007

(54) ENERGY EFFICIENT SHOWERHEAD

(76) Inventor: Albert Leo Schmidt, 1000 W. Eva La., Mt. Prospect, IL (US) 60056

( * ) Notice: Subject to any disclaimer, the term of this patent is extended or adjusted under 35 U.S.C. 154(b) by 716 days.

(21) Appl. No.: 10/685,274

(22) Filed: Oct. 14, 2003

(65) Prior Publication Data

US 2004/0251325 A1 Dec. 16, 2004

Related U.S. Application Data

(62) Division of application No. 10/050,365, filed on Jan. 16, 2002, now Pat. No. 6,631,859.

(51) Int. Cl.
*B05B 15/08* (2006.01)
*B05B 1/14* (2006.01)
*B05B 1/18* (2006.01)

(52) U.S. Cl. ..... 239/587.3; 239/587.4; 239/558

(58) Field of Classification Search ..... 239/587.3, 239/587.4, 558, 391, 392, 394, 396, 456, 239/507, 513, 556, 559, 567, 579, 581.1, 239/587.1, 587.2; 137/625.41
See application file for complete search history.

(56) References Cited

U.S. PATENT DOCUMENTS 2,118,943 A * 5/1938 Price et al. ..... 239/107
2,560,279 A * 7/1951 Curtis ..... 239/590.5
2,565,554 A * 8/1951 Goodrie ..... 239/428.5
2,608,443 A * 8/1952 Hinderer ..... 239/438
2,660,473 A * 11/1953 Hansen ..... 239/109
2,923,482 A * 2/1960 Bucknell ..... 239/591
3,022,014 A * 2/1962 Young ..... 239/438
3,047,239 A * 7/1962 Canavan ..... 239/579
3,383,051 A * 5/1968 Fiorentino ..... 239/460
3,623,670 A * 11/1971 Wakeman et al. ..... 239/428.5
3,887,136 A * 6/1975 Anderson ..... 239/460
4,145,004 A * 3/1979 Krizik ..... 239/499
4,244,526 A * 1/1981 Arth ..... 239/533.1
4,273,289 A * 6/1981 Jette ..... 239/458
4,360,160 A * 11/1982 Jette ..... 239/289
4,394,969 A * 7/1983 Jette ..... 239/414
4,398,668 A * 8/1983 Jette ..... 239/414
4,568,027 A * 2/1986 Lazarus ..... 239/590.3
4,614,303 A * 9/1986 Moseley et al. ..... 239/499
4,850,539 A * 7/1989 Gonzalez ..... 239/558
4,989,791 A * 2/1991 Ridenour ..... 239/579
5,129,584 A * 7/1992 Ridenour ..... 239/579
5,507,534 A * 4/1996 Reifenberger et al. ... 285/122.1
5,613,639 A * 3/1997 Storm et al. ..... 239/581.1
6,343,750 B1 * 2/2002 Engel ..... 239/463

* cited by examiner

*Primary Examiner*—Kevin Shaver
*Assistant Examiner*—Darren Gorman
(74) *Attorney, Agent, or Firm*—Robert A. Brown

(57) ABSTRACT

A showerhead with an internal valve to control the flow of fluid between a full flow and reduced flow condition so as to save energy and thereby conserve the supply of water. The showerhead includes an internal valve that operates easily between an off position and an on position to permit a controlled flow of water from an approximate flow of two and one half gallons per minute to a reduced flow of about one half gallon per minute. The internal valve is formed in a spherical configuration and swivels or rotates between a reduced flow position and a full flow on position; it has formed therein a relatively small by-pass aperture that serves to selectively maintain a predetermined, constant temperature flow of water for a person taking a shower.

3 Claims, 3 Drawing Sheets

ENERGY EFFICIENT SHOWERHEAD

CROSS-REFERENCE TO RELATED APPLICATION

This is a division of application Ser. No. 10/050,365, filed Jan. 16, 2002, now U.S. Pat. No. 6,631,859.

BACKGROUND OF THE INVENTION

The present invention relates generally to a device for directing a stream of fluid through an internal mechanism formed therein and more particularly to a showerhead adaptable to control and meter the flow of water so as to avoid waste of fresh water and energy in heating the water to a comfortable temperature and provide an efficient, continuous, predetermined measurement of the fluid flow through the showerhead. The showerhead operates independently of a main supply valve when it is in an on position and permits unrestricted full flow of water from a supply pipe to a shower stall.

DESCRIPTION OF THE PRIOR ART

A person operating a standard showerhead turns water on and thereafter is required to adjust or regulate a usual first flow of water to a more comfortable temperature and thereby enjoy a pleasant shower. If the person lives in an area where water is in short supply, he or she may, in the interest of conservation, turn off the flow so as to concentrate on applying soap to the body or hair. The person is then required to turn the water back on and again adjust the flow back to a desired temperature of water flow. This is likely to cause some discomfort and waste the use of water before re-locating the position that provides the desired water flow and comfortable water temperature. This, in turn, increases the strain on both rural and municipal, infrastructure water sewage systems and dissipates and wastes the supply of fresh water, which in this modern society is becoming more and more scarce for purposes of human consumption.

The prior art is replete with attempts to advance the state of the art. Illustrative of such attempts are U.S. Pat. No. 4,145,004 to Krizik; U.S. Pat. No. 4,360,160 in the name of Jette; U.S. Pat. No. 4,568,027 to Lazarus; U.S. Pat. No. 4,614,303 in the names of Moseley, Jr. et al; and U.S. Pat. Nos. 4,989,791, 5,129,584, both issued to Ridenour.

Krizik '004 discloses a water saving showerhead having an adapter that moves from an open to a closed position without disrupting the hot and cold water mixture in the supply conduit to the showerhead. The Jette '160 patent disclosed a swiveling showerhead control adapter that shuts off or turns on water without disrupting the hot and cold water mixture in the supply conduit to the showerhead. Lazarus '027 discloses a "conventional" energy saving showerhead which swivels in order to interrupt fluid flow. Moseley, Jr. et al disclose a water saving showerhead directed to provide a drip condition instead of no flow by axial displacement of a plunger. The Ridenour '791 and '584 patents both show a similar concept directed to a valve nozzle assembly wherein the nozzle may be rotated so as to cause shut-off or trickle flow conditions, the '584 reference having been divided from its parent '791 invention.

The above and other like devices consume excess water, increase the amount of energy required to heat fresh water, require excessive amounts of chemicals in treating fresh and waste water with damage to land environment, and the like.

SUMMARY OF THE INVENTION

Therefore, it is primary object of the present invention to provide an improved showerhead that includes a swivelable or rotatable, mechanical device that is easily turned on and off and meters the flow of water so as to conserve energy required to heat water to a temperature for comfortable bathing.

It is a further object of the present invention to provide an improved showerhead that is adjustable to a position where a desired temperature of water flow is achieved, can be turned down and thereafter can be turned on and returned to the previously achieved position of desired water temperature flow.

Another object of the present invention is to provide an improved showerhead having an internal mechanism that includes complementary spherical surfaces in adjustable slidable contact with each other to permit a predetermined measurable discharge of water through the showerhead.

An additional object of the present invention is to provide an improved showerhead having a plurality of internal components that are rotatable adjustable to permit full flow, and minutely metered conditions of reduced flow therebetween.

BRIEF DESCRIPTION OF THE DRAWING

The foregoing and other characteristics, objects, features and advantages of the present invention will become more apparent upon consideration of the following detailed description, having reference to the accompanying figures of the drawing, wherein.

DESCRIPTION OF A PREFERRED EMBODIMENT

Figure 1:
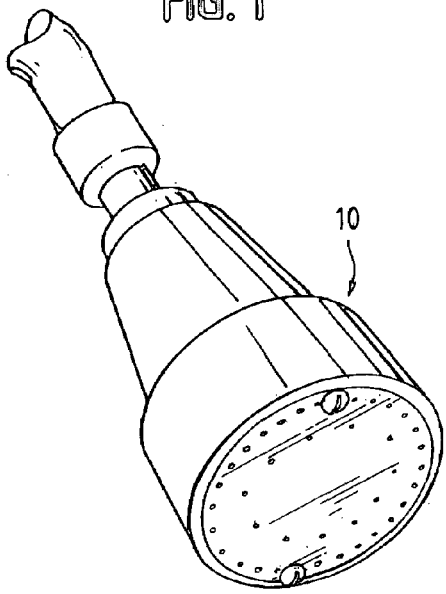
FIG. 1 is a Perspective view of an assembled showerhead wherein internal mechanisms are disposed comprising the elements of the present invention.

Referring now to FIGS. 1–10, there is shown in perspective an improved assembled showerhead, generally indicated by reference numeral 10, including an internal valve that controls the flow of water to prevent a wasteful discharge volume therefrom, but is effective to permit a predetermined rate of volume flow that conserves energy and provides a user friendly temperature for a person taking a shower.

Figure 2:
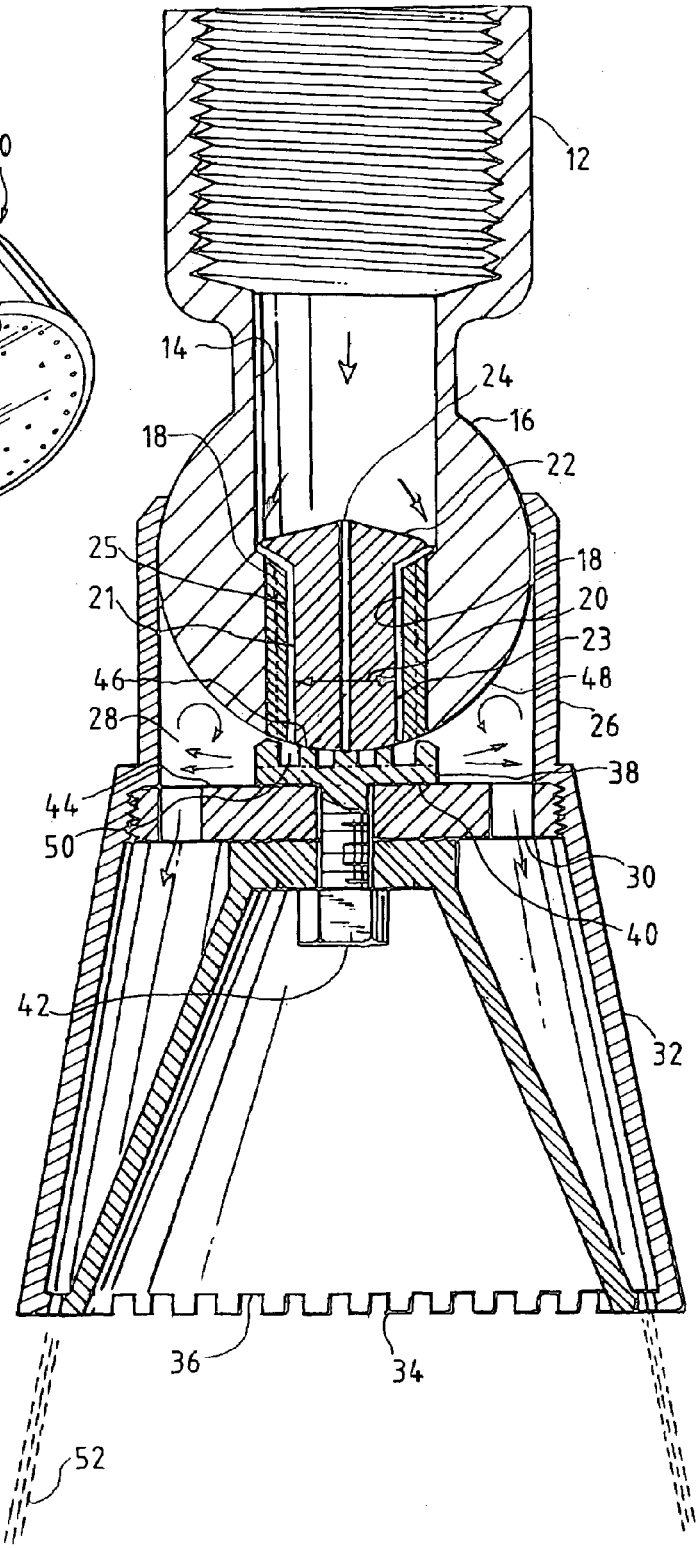
FIG. 2 is an enlarged sectional view of the showerhead of FIG. 1 showing an internal valve of the present invention in an operative condition permitting full flow, unrestricted discharge of water therethrough.

Next referring to FIG. 2, the showerhead 10 comprises an upper, internally threaded, cylindrical housing 12 adaptable for threadably connecting to a pipe, for example, installed in the wall of a shower stall for supply of water thereto. The housing 12 includes an internal, cylindrical passage 14, or bore, leading into a lower spherical member 16. The passage 14 extends into and through the spherical member 16 for a length substantially equal to half of the diameter of the spherical member 16 and then is reduced in diameter for the remainder of its length before exiting from a lower end of the spherical member 16.

A plurality of valve pilot guide rails 18 are arranged in a concentric orientation about a reduced diameter 20 of the bore 14 for receiving therein a regulator or valve pilot member 22 having a water by-pass orifice hole 24 extending therethrough for controlling water temperature when the showerhead is disposed in a reduced flow mode. The guide rails 18 are disposed about and separated from an outer cylindrical surface 21 of reduced diameter 20 so as to permit flow of water from passage 14 through vertical spaces 23 between guide rails 18 and the outer cylindrical surface 21 of reduced diameter 20.

The showerhead 10 includes a lower housing 26 adaptable to rotate universally about the spherical member 16 in any direction within a 360 degree circle. The housing 26 includes an upper chamber 28 that receives water from passage 14 through by-pass 24 and vertical spaces 23 between an outer cylindrical surface 25 of pilot member 22 and guide rails 18.

A bottom floor member 30 or pad of the upper chamber 28 is removably secured in threaded, or other suitable engagement with a depending nozzle member 32 for receiving and discharging the flow of water through a removable orifice member 34 having a plurality of circumferential exit apertures 36.

A valve actuator 38 is formed to provide a flat bottom side 40 that is secured, as by a bolt 42, or other suitable means, to a top horizontal surface 44 of the floor member 30 and has an upper, concave shaped surface 46 that is adaptable at times to engage in sliding contact with a bottom portion 48 of the peripheral surface of the spherical member 16. Also, the valve actuator 38 has formed therein a plurality of grooves 50, as best shown in FIG. 3, which act to allow reduction of the flow of water, or adjust it to a desired flow by hand movement of the showerhead in any direction within a 360 degrees circle of operation.

The structure of FIG. 1 shows the showerhead 10 in an operative condition that permits full flow of water through the exit orifices 36 as illustrated by the dotted lines 52. This full flow of water, under standard municipal conditions, is measured at 2½ gallons per minute with water pressure at 50 pounds per square inch. It should be noted that in the full flow mode shown in FIG. 1, pilot valve 22 is in a raised position to permit water to flow through vertical spaces 23.

Figures 5, 6:
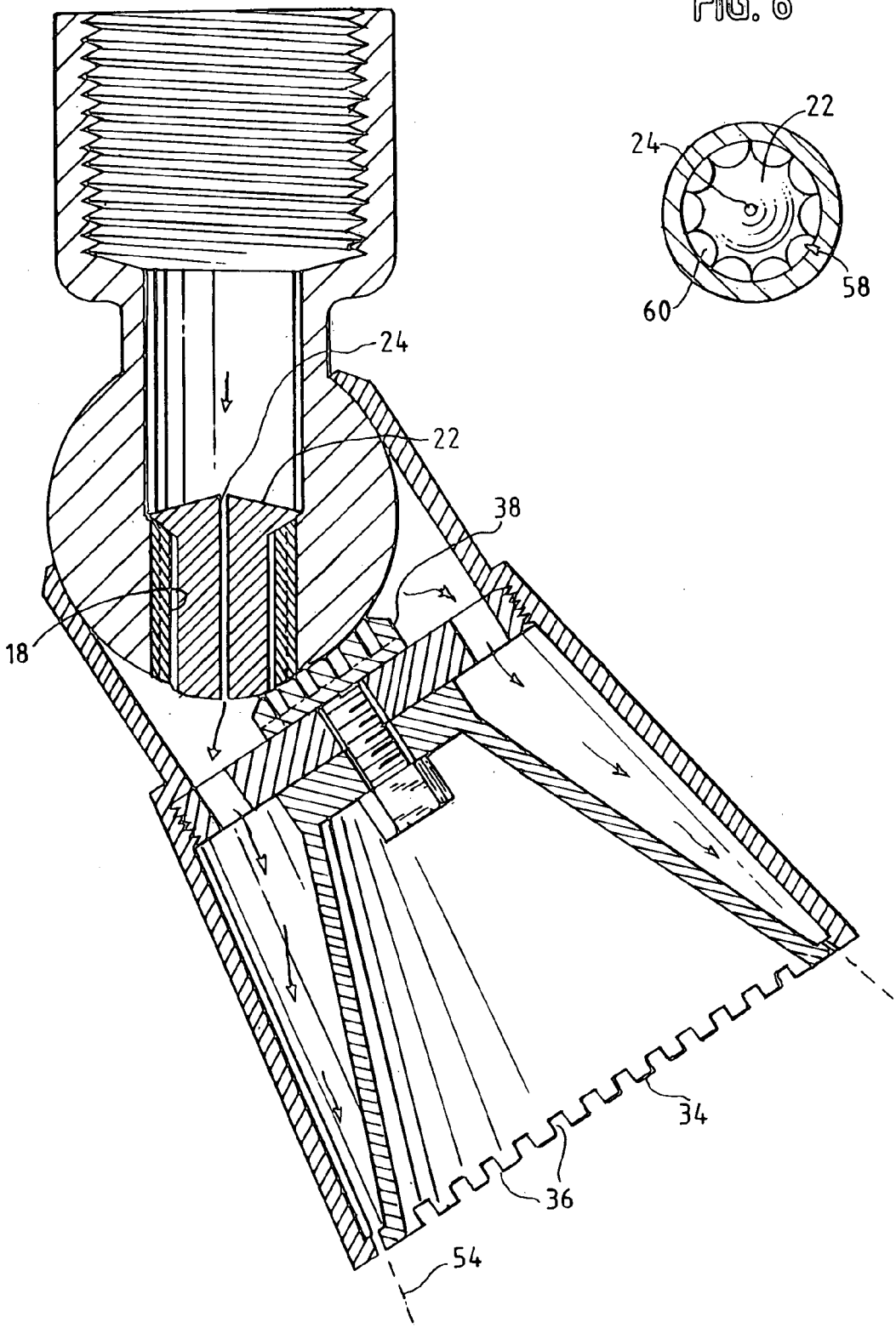
FIG. 5 is an enlarged sectional view of the showerhead of FIG. 1 showing the internal valve of the present invention in an operative condition controlling the flow of water so as to restrict and meter the rate of discharge therethrough.
FIG. 6 is a bottom side view of a pilot valve providing another part of the internal mechanism of the showerhead that controls the flow of water therethrough and showing a second embodiment of construction of the pilot valve.

FIG. 5 shows structure identical to FIG. 2, but depicts an operable condition that controls the flow of water so as to provide a desired volume of flow along with a temperature that is comfortable to a user, and is illustrated by the dotted line 54. In this mode, the pilot valve 22 is seated against top portions of guide rails 18 to shut off the flow of water therethrough. It should be noted that by-pass opening 24 permits a reduced flow of water that serves to maintain the temperature thereof in a condition that is comfortable to the user. The reduced flow of water in this mode is in the range of one and one half guarts per minute.

Figure 3:
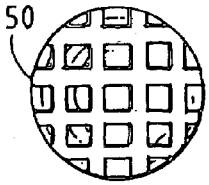
FIG. 3 is a top plan view of a valve actuator providing one part of the internal mechanism of the showerhead to control the flow of water therethrough.
Figure 4:
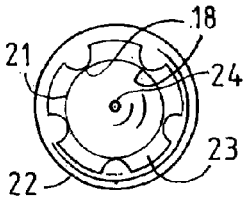
FIG. 4 is a bottom side view of a pilot valve providing another part of the internal mechanism of the showerhead that controls the flow of water therethrough and showing a first embodiment of construction of the pilot valve.

FIG. 3 further illustrates the valve actuator 38 of FIGS. 2 and 5 and shows in detail its circular construction and configuration of grooves 50. FIG. 4 additionally describes the pilot valve 22 of FIGS. 2 and 5 showing in detail its circular construction and orientation of its guide rails 18 disposed about and spaced from the outer cylindrical surface 25 of the pilot valve 22. Also, the by-pass orifice 24 is shown in its centrally disposed location.

In FIG. 6 there is shown the pilot valve 22 wherein there is formed an internal construction of a plurality of members 58 formed to provide vertical flutes or grooves 60 for selectively controlling the volume flow of water.

Figure 7:
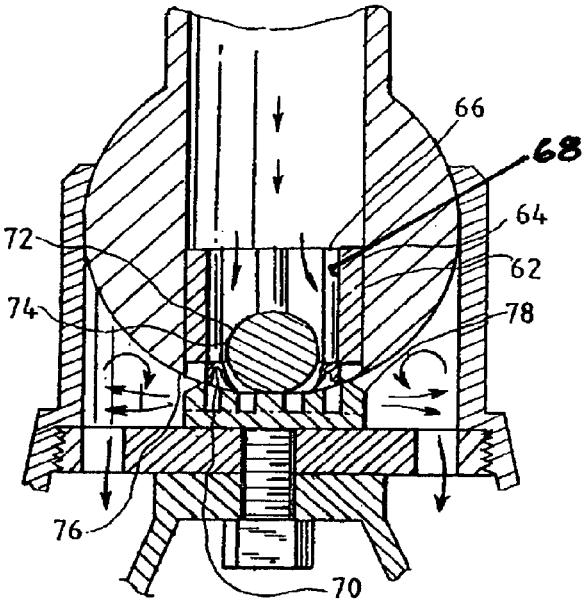
FIG. 7 is an enlarged sectional view of the showerhead of FIG. 1 showing an alternate construction of the internal valve of the present invention in an operative condition permitting full flow, unrestricted discharge of water therethrough.

Next referring to FIG. 7, the showerhead 10 is depicted wherein an alternate construction of a pilot valve 62 is disposed within the spherical moor 16. The pilot valve 62 includes a cylindrical valve body 64, and a plurality of vertical guide rails 66 engaged with an inner circumferential surface 68 of the valve body 64. A circular water by-pass groove 70 is located at a bottom portion of the pilot valve adjacent the circumferential surface 68. A non-corrosive ball or sphere 72 is located within the pilot valve 62 in contact with the guide rails 66 and has an outer spherical surface 74 that is complementary to and in slidable contact with an upper concave surface 76 of a valve actuator 78.

Figure 8:
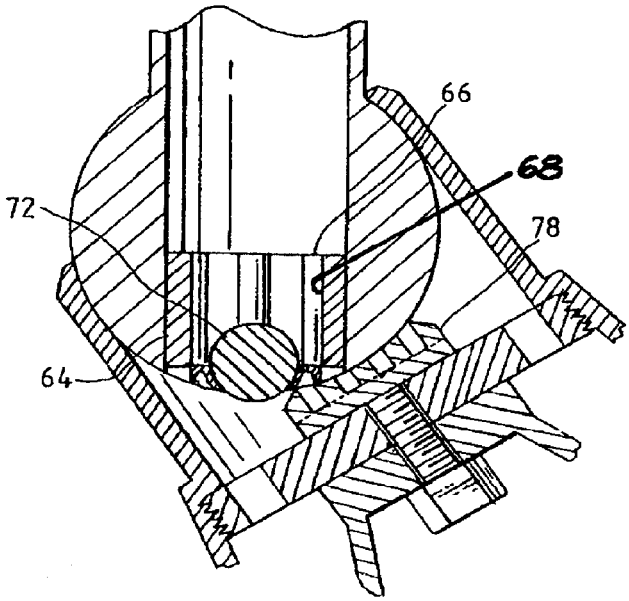
FIG. 8 is an enlarged sectional view of the showerhead of FIG. 1 showing an alternate construction of the internal valve of the present invention an operative condition controlling the flow of water so as to restrict and measure the volume rate of discharge therethrough.

FIG. 8 shows structure identical to FIG. 7, but depicts an operable condition that controls the flow of water so as to provide a desired volume of flow along with a temperature that is comfortable to a user, and is illustrated by the dotted line 54.

Figure 9:
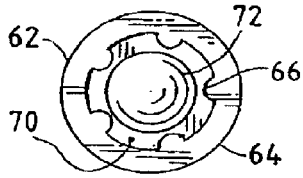
FIG. 9 is a top plan view of the pilot valve of FIGS. 7 and 8 showing the alternate construction of the valve that controls the flow of water so as restrict and meter the volume rate of discharge therethrough.

FIG. 9 depicts a top plan view of the pilot valve 62 of FIG. 7 showing in detail its circular construction, orientation of guide rails 66, water by-pass groove 70, and a location of a water by-pass orifice 80 disposed along an outer peripheral surface of the by-pass groove 70.

Figure 10:
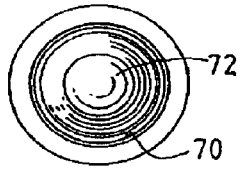
FIG. 10 is a bottom side view of the pilot valve of FIGS. 7 and 8 showing the alternate construction thereof that controls the flow of water so as to restrict and measure the volume rate of discharge therethrough.

FIG. 10 provides a bottom side view of the pilot valve 62 of FIG. 7 showing in detail its circular construction, concentrically disposed ball 72, circular water by-pass groove 70, and its eccentrically located water by-pass orifice 80 disposed along the outer peripheral surface of the by-pass groove 70.

Figure 11:
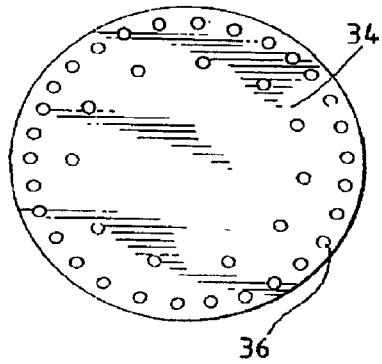
FIG. 11 is a bottom side view of a removable slotted member providing apertures for discharge of full flow or reduced flow water.

FIG. 11 shows in detail the plurality of orifices or apertures in the showerhead exit member.

In the operation of the invention, water is introduced into the showerhead by opening a main water supply valve. The water flows to the showerhead 10 and because of thermal differences in the supply pipe with the showerhead in the full flow position of FIG.1, the user may be subjected to a burst of hot water. The user then rotates the nozzle member 32 about the spherical member 16 to a position where the flow of water is at a desired and pleasant temperature. This is accomplished by reducing the flow of water from the entry passage 14 into and around the pilot valve 22, permitting flow through by-pass orifice 24 so as to meter the flow of water through the actuator valve 38 and thereby controlling the discharge of water through apertures 36 of the showerhead 10. The invention operates in a similar manner as shown in FIGS. 7 and 8, except for the alternate construction of the ball 72.

While the present invention has been described with reference to the above preferred embodiments, it will be understood by those skilled in the art, that various changes may be made and equivalence may be substituted for elements thereof without departing from the scope of the present invention. In addition, modifications may be made to adapt a particular situation or material to the teachings of the present invention without departing from the scope of the present invention. Therefore, it is intended that the invention not be limited to the particular embodiments disclosed in carrying out this invention, but that the present invention includes all embodiments falling within the scope of the appended claims.

I claim:

1. An energy efficient showerhead comprising a first housing for attachment to a main supply conduit of a shower, said first housing having formed at a lower end a spherical member, said spherical member having a bore formed therethrough for receiving water from the supply conduit, a valve actuator having an upper concave surface complementary to and at times in slidable contact with an outer surface of said spherical member, a regulator valve disposed within a lower portion of said bore for control of water between full flow and reduced flow, said regulator valve including a ball for slidable contact with the valve actuator, and a cylindrical valve body defining an inner circumferential surface, guide rails disposed about and spaced from the inner circumferential surface of the regulator valve, a second housing secured to a bottom surface of said valve actuator and operable to rotate said valve actuator about the outer surface of the spherical member, whereby selective rotation of the second housing is effective to position the valve actuator and the spherical member in a complementary relationship so as to maintain a desired temperature at a reduced flow of water discharge from the showerhead.

2. An energy efficient showerhead as claimed in claim 1 including a groove disposed about the ball at a lower end of the bore of the first housing for by-passing water from said first to said second housing of the showerhead.

3. An energy efficient showerhead as claimed in claim 1 wherein said second housing is operable to swivel 360 degrees about said first housing.

* * * * *